US006375301B1

(12) United States Patent
Childers et al.

(10) Patent No.: US 6,375,301 B1
(45) **Date of Patent: *Apr. 23, 2002**

(54) REPLACEABLE CARTRIDGE, KIT AND METHOD FOR FLUSHING INK FROM AN INKJET PRINTER

(75) Inventors: Winthrop D Childers, San Diego, CA (US); Norman E Pawlowski, Jr., Corvallis, OR (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/785,579

(22) Filed: Jan. 21, 1997

(51) Int. Cl.[7] ..... B41J 2/165; B41J 29/393

(52) U.S. Cl. ..... 347/28; 347/19

(58) Field of Search ..... 347/22, 24, 28, 347/86, 19, 5

(56) References Cited

U.S. PATENT DOCUMENTS

| | | | | |
|---|---|---|---|---|
| 4,551,000 A | | 11/1985 | Kanemitsu et al. | 347/28 |
| 4,803,521 A | | 2/1989 | Honda | 347/28 |
| 4,961,088 A | | 10/1990 | Gilliland et al. | 347/28 |
| 5,021,828 A | | 6/1991 | Yamaguchi et al. | 347/28 |
| 5,138,344 A | | 8/1992 | Ujita | 347/28 |
| 5,184,181 A | | 2/1993 | Kurando et al. | 347/28 |
| 5,272,503 A | | 12/1993 | LeSueur et al. | 347/28 |
| 5,365,312 A | | 11/1994 | Hillmann et al. | 347/28 |
| 5,410,641 A | | 4/1995 | Wakabayashi et al. | 347/28 |
| 5,506,611 A | | 4/1996 | Ujita et al. | 347/28 |
| 5,610,635 A | | 3/1997 | Murray et al. | 347/7 |
| 5,917,512 A | * | 6/1999 | Weber et al. | 347/28 |

FOREIGN PATENT DOCUMENTS

| | | |
|---|---|---|
| EP | 720916 A2 | 7/1996 |
| GB | 0 556 011 A2 | 8/1993 |
| JP | 08156284 | 6/1996 |
| JP | 05185599 | 7/1996 |
| JP | 08295029 | 11/1996 |
| JP | 09039260 | 2/1997 |

OTHER PUBLICATIONS

Xerox Disclosure Journal, vol. 8, No. 6, Nov./Dec. 1983, p. 503, R. A. Lonis, "Storage of Operating Parameters in Memory Integral with Printhead".

* cited by examiner

*Primary Examiner*—Judy Nguyen

(57) ABSTRACT

A replaceable reservoir cartridge is provided for use in an inkjet apparatus, wherein a reservoir cartridge with a first ink has been installed and which is to be replaced by a reservoir cartridge including a second ink. The replaceable reservoir cartridge includes a supply of fluid for flushing the first ink from the pathways in the inkjet apparatus. A memory is carried by the replaceable reservoir cartridge and couples to a processor within the inkjet apparatus when the replaceable reservoir cartridge is installed. The memory includes parameters, which, upon being accessed and utilized by a procedure stored in the processor, causes a printing of a plurality of disposable media sheets to enable a flushing of the first ink from pathways in the inkjet apparatus. The replaceable reservoir cartridge may be incorporated into a kit which further includes a storage media (i.e., a diskette) with a procedure for controlling the inkjet apparatus to enable operation of the flushing action. The kit may also include a printhead which includes resident memory that includes a parameter which defines an amount of the fluid in the replaceable reservoir cartridge to be used for flushing purposes, that parameter being less than would otherwise be required if the printhead was not being replaced.

17 Claims, 3 Drawing Sheets

REPLACEABLE CARTRIDGE, KIT AND METHOD FOR FLUSHING INK FROM AN INKJET PRINTER

FIELD OF THE INVENTION

This invention relates to inkjet printers and, more particularly, to a method and apparatus for flushing ink from elements of an inkjet printer.

BACKGROUND OF THE INVENTION

Substantially all present-day copiers, printers, plotters, etc., require entry of usage, calibration and other data. In regards to ink jet printers, it has been proposed that printheads incorporate a parameter memory for storage of operating parameters to be used by the printer for calibration purposes. Such parameters include: drop generator driver frequency, ink pressure and drop charging values (see "Storage of Operating Parameters in Memory Integral with Print Head", Lonis, Xerox Disclosure Journal, Volume 8, No. 6, November/December 1983, page 503).

U.S. Pat. No. 5,138,344 to Ujita, entitled "Ink Jet Apparatus and Ink Jet Cartridge Therefor", indicates that an ink-containing replaceable cartridge can be provided with an integral information device (i.e., a resistor element, magnetic medium, bar code, integrated circuit or ROM), for storage of information relating to control parameters for an ink jet printer.

U.S. Pat. No. 5,365,312 to Hillmann et al., entitled "Arrangement for Printer Equipment Monitoring Reservoirs that Contain Printing Medium", describes the use of memory devices with integral ink reservoirs for storage of ink consumption data (for use by a coupled ink jet printer). European patent EP 0 720 916, entitled "Ink Supply Identification System for a Printer" describes the use of an ink supply having an integral EEPROM which is utilized to store data regarding the identity of the ink supply and its fill level.

The prior art further teaches the use of consumable parts with integral memory for use in electrophotographic printers. In U.S. Pat. No. 5,021,828 to Yamaguchi et al., entitled "Copying Apparatus having a Consumable Part", a toner cartridge is disclosed which includes a memory for storing data regarding to the state of consumption of toner in the cartridge. U.S. Pat. No. 4,961,088 to Gilliland et al.; U.S. Pat. No. 4,803,521 to Honda; U.S. Pat. No. 5,184,181 to Kurando et al.; and U.S. Pat. No. 5,272,503 to LeSueur et al. all describe various replaceable toner cartridges for use in electrophotographic printers. Each cartridge incorporates a memory device for storing parameter data regarding the cartridge.

Ink compositions used in ink jet printers are constantly being improved. In the course of such improvements, however, new ink compositions may be found to be incompatible with previous ink compositions. For instance, a new ink composition may combine with the old ink composition to form a precipitate, causing tubing and/or the printhead to clog. Further, when installing an ink cartridge with a new ink composition, if the old ink is still present in the tubing and printhead of the printer, the properties of the ejected ink will be altered. This can be an especially severe problem when a different colored ink is substituted for a previously used ink. Thus, until the old ink is purged, the print quality will suffer. In general, any time a new ink is to be used in place of a non-identical ink, a potential incompatibility issue is presented (e.g., different colors, densities, solvents, pigments, surfactants, etc.)

Accordingly, it is an object of this invention to provide a replaceable cartridge for use in an ink jet apparatus which enables a flushing of ink therefrom.

It is another object of this invention to provide a kit for use with an ink jet apparatus, which kit includes an ink cartridge including a fluid that is usable, at least in part, to flush a previous ink type from components of the apparatus.

It is yet another object of this invention to provide a replaceable ink cartridge that is usable to flush ink from an inkjet printer, wherein the cartridge includes integral memory means which cooperates with the inkjet printer to enable operation of the flush action.

SUMMARY OF THE INVENTION

A replaceable reservoir cartridge is provided for use in an inkjet apparatus, wherein a reservoir cartridge with a first ink has been installed and which is to be replaced by a reservoir cartridge including a second ink. The replaceable reservoir cartridge includes a supply of fluid for flushing the first ink from the pathways in the inkjet apparatus. A memory is carried by the replaceable reservoir cartridge and couples to a processor within the inkjet apparatus when the replaceable reservoir cartridge is installed. The memory includes parameters, which, upon being accessed and utilized by a procedure stored in the processor, causes a printing of a plurality of disposable media sheets to enable a flushing of the first ink from the pathways in the inkjet apparatus. The replaceable reservoir cartridge may be incorporated into a kit which further includes a storage media (i.e., a diskette) with a procedure for controlling the inkjet apparatus to enable operation of the flushing action. The kit may also include a printhead which includes resident memory that includes a parameter which defines an amount of the fluid in the replaceable reservoir cartridge to be used for flushing purposes, that parameter being less than would otherwise be required if the printhead was not being replaced.

DETAILED DESCRIPTION OF THE INVENTION

Figure 1:
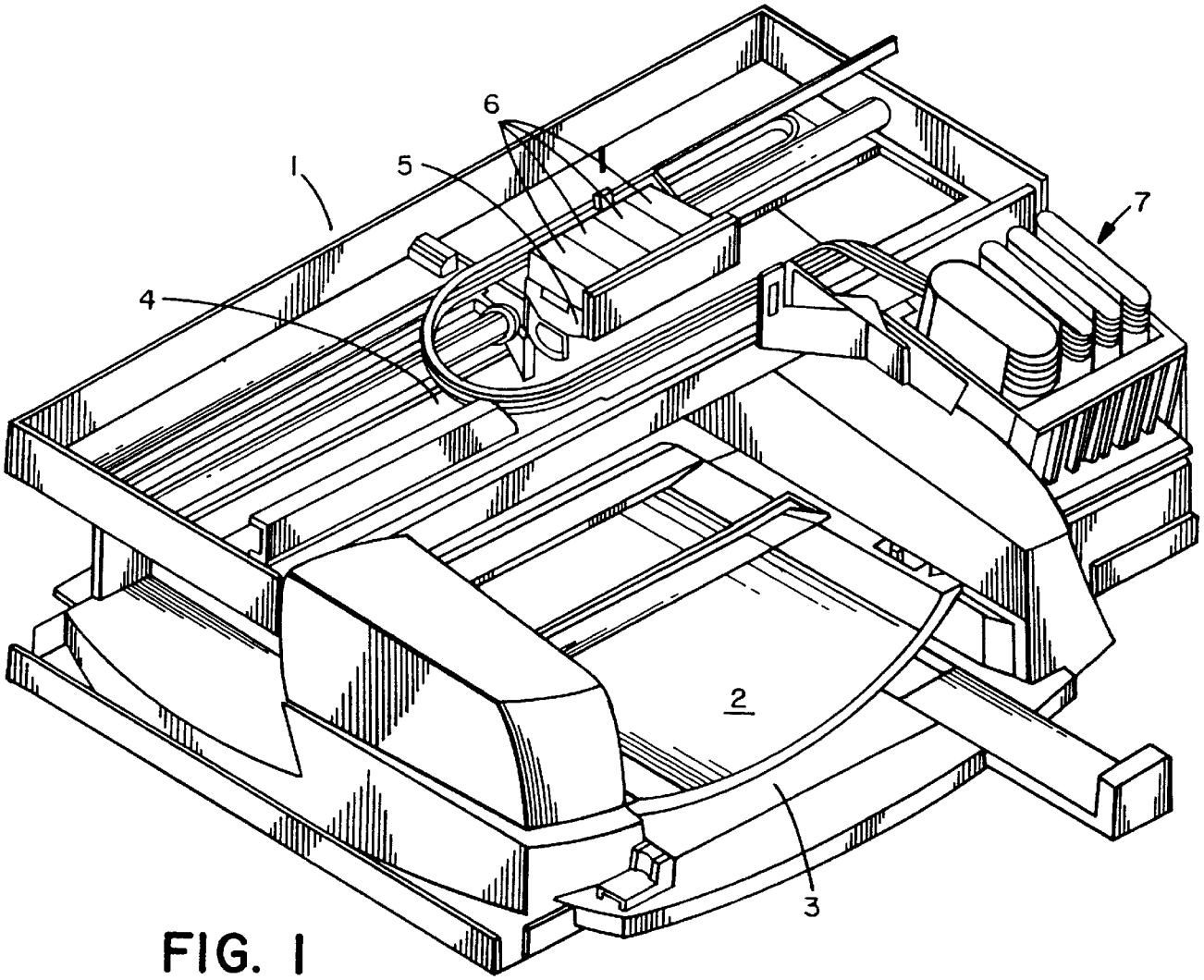
FIG. 1 a perspective view of an inkjet printer (with cover removed) which incorporates the invention.

FIG. 1 illustrates a perspective view of an inkjet printer 1 which incorporates the invention. A tray 2 holds a supply of input paper or other print media. When a printing operation is initiated, a sheet of paper is fed into printer 1 and is then brought around in a U-direction towards an output tray 3. The sheet is stopped in a print zone 4 and a scanning cartridge 5, containing plural removable color printheads 6 is scanned across the sheet for printing a swath of ink thereon. The process repeats until the entire sheet has been printed, at which point it is ejected onto output tray 3.

Printheads 6 are, respectively, fluidically coupled to four removable ink cartridges 7 holding, for example, cyan, magenta, yellow and black inks, respectively. Since black ink tends to be depleted most rapidly, the black ink cartridge has a larger capacity than the other ink cartridges. As will be understood from the description which follows, each printhead and ink cartridge is provided with an integral memory device which stores data that is used,by printer 1 to control its printing operations.

Figure 2:
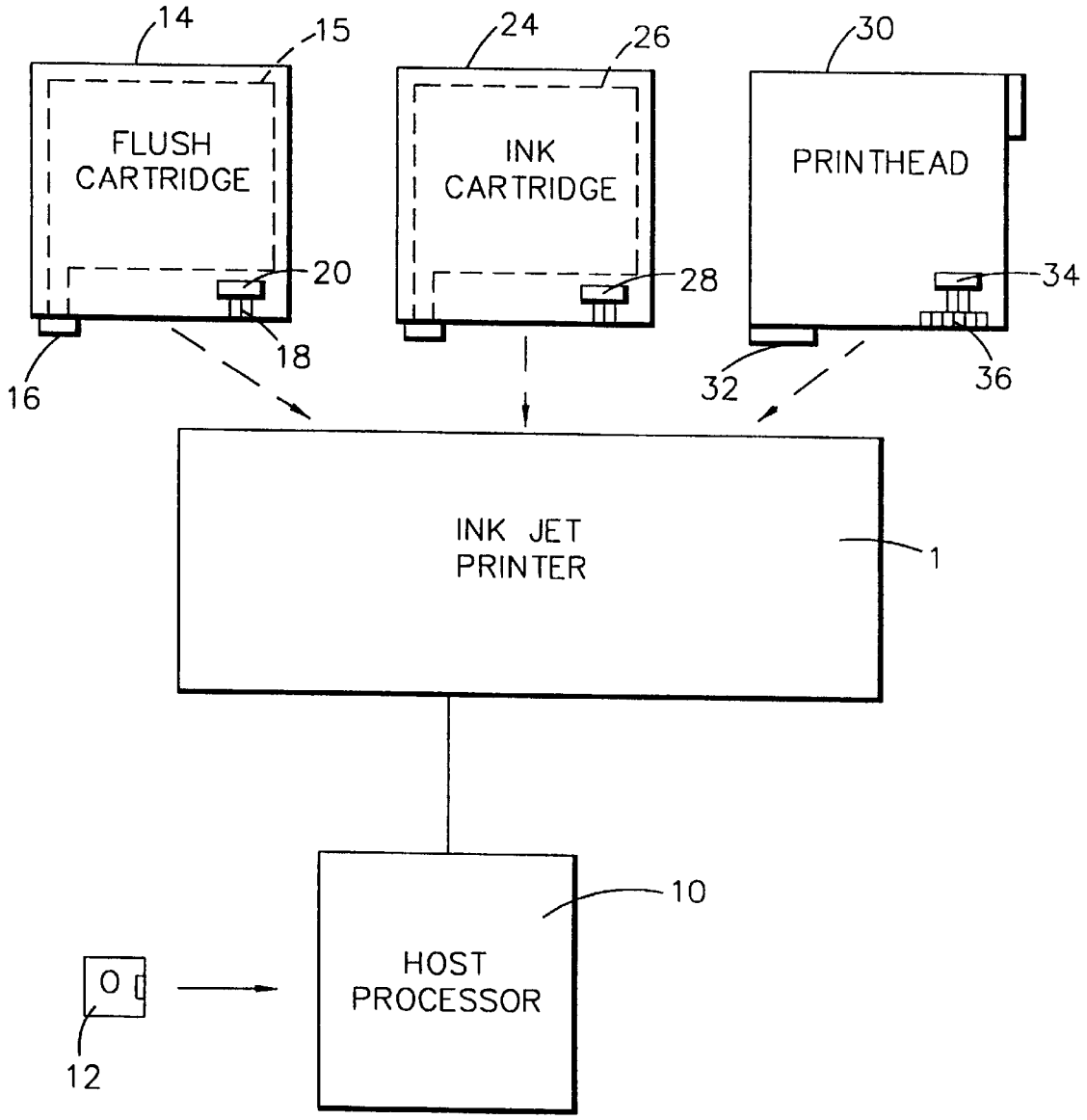
FIG. 2 is a block diagram of the inkjet printer of FIG. 1, showing replaceable elements therefor, includinig a flush cartridge, an ink cartridge and a printhead.

In FIG. 2, a host processor 10 connects to inkjet printer 1 and provides both control and data signals therefor. Host processor 10 is adapted, in the known manner, to receive a memory media cassette 12 which includes an operating program for controlling a flush action within inkjet printer 1. As indicated above, inkjet printer 1 is capable of receiving a plurality of pluggable ink cartridges containing one or more colors for use by the printhead. To accomplish a flush action, a first embodiment of the invention employs a flush cartridge 14 which is configured identically to normal replacement ink cartridge 24.

Flush cartridge 14 includes a reservoir 15 including a supply of flush fluid, a fluidic coupler 16 and an electrical connector 18, both of which couple to mating connectors within inkjet printer 1 upon installation of flush cartridge 14. A memory chip 20, installed on flush cartridge 14, is coupled to connector 18 and contains parameters that are used by inkjet printer 1 to control the flush action. Electrical connector 18 also makes connection with other elements within flush cartridge 14 which serve to monitor the level of a flush fluid within reservoir 15.

The fluid within reservoir 15 of flush cartridge 14 is preferably a supply of the liquid vehicle (i.e., a solvent) to be utilized with the new ink. The ink vehicle will not includes pigment so as to avoid any interaction between the old and new pigment materials. It is to be understood, however, that the fluid within flush cartridge 14 can be any fluid which performs the desired action of flushing old ink from the ink pathways within printer 1.

Ink cartridge 24 is identical in structure to flush cartridge 14, however, its reservoir 26 includes a replacement ink supply for inkjet printer 1. Memory 28 includes parameters which are specifically derived for use with the replacement ink and by inkjet printer 1 for control of its print action when employing the replacement ink.

A printhead 30 also includes a fluidic coupler region 32, a resident memory 34 and an electrical connector 36 which makes connection to memory 34, as well as other sense and control devices within printhead 30.

Figure 3:
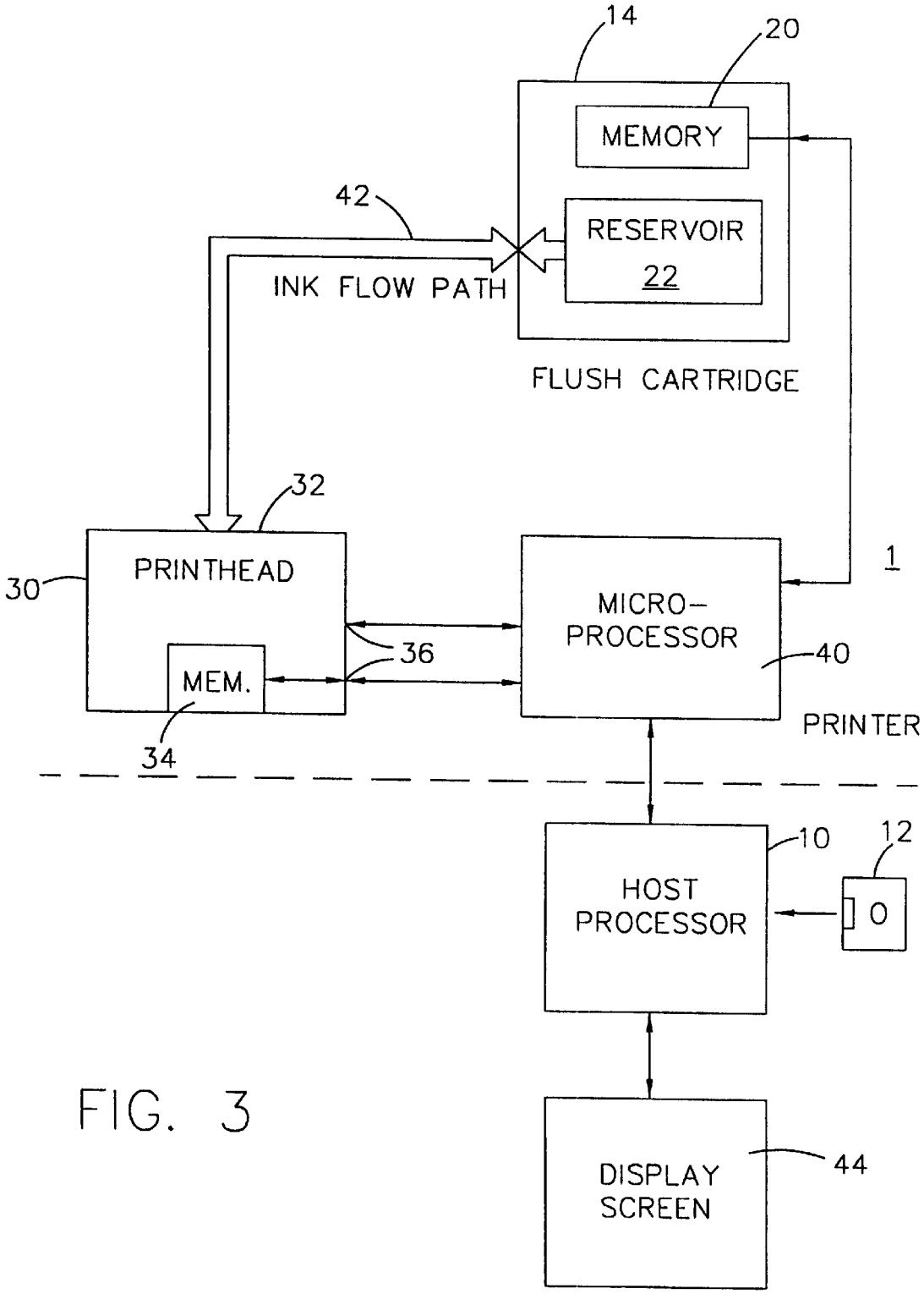
FIG. 3 is a block diagram showing connection of the component within the inkjet printer of FIG. 1.

FIG. 3 illustrates interconnections between a microprocessor 40, which controls the operation of inkjet printer 1, flush cartridge 14 and printhead 30. An ink flow path 42 provides a flow path between flush cartridge 14 and printhead 30.

As above indicated, flush cartridge 14 is used when there is need to flush old ink from ink flow path 42 and printhead 30 to enable a new ink supply to be utilized. To commence the flush action, the user loads diskette 12, containing a flush control procedure, into microprocessor 10 and enters a command, such as "new ink". Host processor 10 then begins execution of the flush procedure. Computer screen 44 prompts the user to remove and discard the old ink cartridge and to replace it with flush cartridge 14 and then to click on a screen button. Thereafter, the host processor 10 asks the user to put "scratch paper" in the printer's paper tray and to again click on a screen button. At such time, printer 1 commences printing a number of pages, using the ink vehicle contained within flush cartridge 14.

This action enables sufficient printing to occur to completely flush the old ink from ink flow path 42 and printhead 30. Printer 1 is preferably controlled to print at 100% density area fill which acts to purge the old ink and to replace it with the ink carrier.

Thereafter, at the finish of the print action, screen 44 prompts the user to remove flush cartridge 14 and to replace it with ink cartridge 24 (FIG. 1) containing a new ink supply. When the replacement action had been completed, the user is instructed to click on a screen button and printer 1 commences printing a number of pages to remove the ink carrier from ink flow path 42 and printhead 30. Thereafter, printer 1 is ready to handle print jobs in the normal manner.

If the user accidentally installs a new ink cartridge 24 prior to installing flush cartridge 14, host processor 10 alerts the user to the fact that the ink in cartridge 24 is an incompatible variety. Host processor 10 then instructs the user to remove ink cartridge 24 and to install flush cartridge 14. Host processor 10 inhibits further printing with new ink cartridge 24 until a flush procedure is run.

As can be seen, a significant advantage from having memory elements on cartridges 14 and 24 is to prevent damage to the ink delivery system of printer 10 which might occur if an attempt is made to use two inks that are mutually precipitating or have another compatibility problem. A further advantage is that the flush control procedure can be set up to provide the user with status data regarding the progress of the flush operation Memory 20 on flush cartridge 14 contains parameters which enable microprocessor 40 (i) to identify the fact that flush cartridge 14 is the appropriate cartridge to perform a flush action; and (ii) to access a parameter which identifies the number of pages to be printed so as to enable a complete flushing of ink flow path 42 and printhead 30. So long as printhead 30 is not replaced after the flush action, the parameter, indicating the number of pages that is stored in memory 20, controls the operation of microprocessor 40. If, however, printhead 30 is replaced after the flush action, its memory 34 includes a parameter indicating a lesser number of pages to be printed than the number of pages indicated by the parameter in memory 20. This is due to the fact that there is no resident ink in printhead 30 to be flushed.

Thus, if a new printhead 30 is installed, and the user indicates such action by clicking on a screen button, the parameter from memory 34 regarding number of pages to be printed during the flush action is utilized in lieu of the parameter from memory 20.

The above description has assumed an incompatibility between the new ink and the old ink still resident in ink flow path 42 and printhead 30. If the new and old inks are compatible (e.g., will mix without doing damage to the printer), then flush cartridge 14 may simply be a cartridge containing the new ink. In such case, the flush procedure is still executed, however, it is the new ink which is utilized to flush ink flow path 42 and printhead 30.

When an ink cartridge is installed that has a fluid or ink composition that is different from that currently present in the printer, the user receives a warning. In the preferred embodiment, the user is given the option of removing cartridge containing the new ink or going through with a flush action. The cartridge (and its memory element) thus form a critical element of a checking system that prevents the user from accidentally damaging the printer or producing a print job whose quality is degraded.

It is preferred that flush cartridge 14 and diskette 12 be configured as a kit. The kit may also include a replacement printhead 30, if such is needed.

A kit for use with an inkjet apparatus in which a reservoir cartridge with a first ink has been installed includes a storage media with a procedure for controlling said inkjet apparatus upon installation of said replaceable reservoir cartridge thereinto; and a replaceable reservoir cartridge comprising a supply of fluid for flushing said first ink from pathways in said inkjet apparatus; and a memory that couples to a processor in said inkjet apparatus upon installation of said replaceable reservoir cartridge therein, said memory including flush control parameters which, upon being accessed and utilized by said procedure, provide a notice to a user of said installation of said replaceable reservoir cartridge and that a fluid other than said first ink has been installed, and enable said user to selectively cause a printing of a plurality of media sheets through use of said fluid to enable a flushing of said first ink from said pathways.

The kit may further comprise a printhead for printing with said second ink; and a printhead memory for coupling to said processor in said inkjet apparatus upon installation of said printhead thereinto, said printhead memory including a parameter value which defines an amount of said fluid to be utilized to flush said first ink from said pathways, said parameter upon being accessed and utilized by said procedure, overriding a similar parameter value accessed from said memory on said replaceable reservoir cartridge by said procedure, whereby there occurs a printing of a lesser plurality of media sheets to enable a flushing of said first ink from said pathways.

As can be seen from the above, the use of a flush cartridge and a flush action removes incompatibility issues when marketing improved ink compositions. Further, after the flush action, the printer is ready for normal print actions using the new ink composition, as the old ink has been completely removed from the system. The on-screen guidance provided by host processor 10, in response to the program contained on diskette 12, when combined with flush cartridge 14 and, possibly, printhead 30, enables an ink change-over process to readily be accomplished by the user.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A replaceable reservoir cartridge for use in an inkjet apparatus in which a reservoir cartridge with a first ink has been installed and which is to receive a reservoir cartridge with a second ink, said replaceable reservoir cartridge comprising:

a supply of fluid for flushing said first ink from pathways in said inkjet apparatus; and a memory that couples to a processor in said inkjet apparatus upon installation of said replaceable reservoir cartridge thereinto, said memory including flush control parameters which, upon being accessed and utilized by a procedure stored in said inkjet apparatus, provide a notice to a user of said installation of said replaceable reservoir cartridge and that a fluid other than said first ink has been installed, and enable said user to selectively cause a printing of a plurality of media sheets to enable a flushing of said first ink from said pathways.

2. A replaceable reservoir cartridge as recited in claim 1, wherein said first ink is incompatible with said second ink and said supply of fluid includes a solvent for said first ink.

3. A replaceable reservoir cartridge as recited in claim 1, wherein said parameters, which upon being accessed and utilized, further provide said user with an option to selectively cause a printing of a plurality of media sheets to enable a flushing of said first ink from said pathways, and with an option to remove said replaceable reservoir cartridge.

4. A replaceable reservoir cartridge as recited in claim 1, wherein said first ink is compatible with said second ink and said supply of fluid comprises a supply of said second ink.

5. A kit for use with an inkjet apparatus in which a reservoir cartridge with a first ink has been installed, said kit comprising:

a replaceable reservoir cartridge comprising:

a supply of fluid for flushing said first ink from pathways in said inkjet apparatus; and a memory that couples to a processor in said inkjet apparatus upon installation of said replaceable reservoir cartridge therein, said memory including flush control parameters which, upon being accessed and utilized by said procedure, provide a notice to a user of said installation of said replaceable reservoir cartridge and that a fluid other than said first ink has been installed, and enable said user to selectively cause a printing of a plurality of media sheets through use of said fluid to enable a flushing of said first ink from said pathways; and a storage media with a procedure for controlling said inkjet apparatus upon installation of said replaceable reservoir cartridge thereinto.

6. A kit as recited in claim 5, wherein said flush control parameters, which upon being accessed and utilized, further provide said user with an option to selectively cause a printing of a plurality of media sheets to enable a flushing of said first ink from said pathways, and with an option to remove said replaceable reservoir cartridge.

7. A kit as recited in claim 5, wherein said first ink is incompatible with said second ink and said supply of fluid includes a solvent for said first ink.

8. A kit as recited in claim 5, further comprising;

printhead for printing with said second ink; and a printhead memory for coupling to said processor in said inkjet apparatus upon installation of said printhead thereinto, said printhead memory including a parameter value which defines an amount of said fluid to be utilized to flush said first ink from said pathways, said parameter upon being accessed and utilized by said procedure, overriding a similar parameter value accessed from said memory on said replaceable reservoir cartridge by said procedure, whereby there occurs a printing of a lesser plurality of media sheets to enable a flushing of said first ink from said pathways.

9. A kit as recited in claim 6, wherein said first ink is compatible with said second ink and said supply of fluid comprises a supply of said second ink.

10. A method for changing ink in an ink jet printer from a first ink to a second ink, said ink jet printer including a processor, a printhead mounted on a carriage, a fluid conduit with an inlet end and an outlet end in fluid communication with the printhead, and a first cartridge containing said first ink that is in fluid communication with the inlet end of said fluid conduit when it is releaseably mounted in a fixed supply station, the first ink initially resident in said printhead and said fluid conduit, said fist ink cartridge including a first memory for containing at least a first ink parameter and having a first cartridge electrical connector that contacts an electrical connector to couple said first memory with said processor, said method comprising:

providing a second cartridge that contains a supply of a fluid for flushing said first ink from said fluid conduit, said second cartridge including a second memory for storing at least a fluid parameter comprising a flush control parameter and including a second cartridge electrical connector;

decoupling said inlet end of said fluid conduit from said first ink cartridge and said first cartridge electrical connector from said inkjet printer;

coupling said inlet end of said fluid conduit to said second ink cartridge;

coupling said second cartridge electrical connector to said inkjet printer;

transmitting said fluid parameter to said processor and providing a notice to a user of installation of said second ink cartridge and that a fluid other than said first ink has been installed;

selectively enabling said user to enter a command;

upon entry of said command by said user, providing energization signals in response to said fluid parameter to said printhead in said inkjet printer such that said printhead ejects fluid onto media while the carriage scans; and channeling said fluid from said second cartridge to said printhead while providing said energization signals to said printhead until said fluid substantially replaces said first ink in said fluid conduit and said printhead.

11. The method of claim 10 wherein selectively enabling further includes providing said user with an option to selectively cause a printing of a plurality of media sheets to enable a flushing of said first ink from said pathways, and with an option to remove said replaceable reservoir cartridge.

12. The method of claim 10, wherein said first ink is incompatible with said second ink and said supply of fluid includes a solvent for said first ink.

13. The method of claim 12, further including:

providing a third cartridge that contains said second ink for flushing said fluid from said fluid conduit, said third cartridge including a third memory containing at least a second ink parameter and a third cartridge electrical connector;

decoupling said inlet end of said fluid conduit from said second ink cartridge, and said second cartridge electrical connector from said inkjet printer;

coupling said inlet end of said fluid conduit to said third ink cartridge;

coupling said third cartridge electrical connector to said inkjet printer;

transmitting said second ink parameter to said processor and providing a notice to a user of installation of said third ink cartridge and that a fluid other than said first ink has been installed;

upon entry of a command by said user, providing energization signals to said printhead such that said printhead ejects fluid onto media while the carriage scans; and channeling said second ink from third cartridge to said printhead while providing said energization signals to said printhead until said second ink substantially replaces said fluid in said fluid conduit and said printhead with said second ink.

14. The method of claim 10, wherein said first ink is compatible with said second ink and said supply of fluid comprises a supply of said second ink.

15. The method of claim 10, wherein said ink jet printer derives a first printer function control value that is dependent upon said first ink parameter.

16. The method of claim 15, wherein said ink jet printer derives a second printer function control value that is dependent upon said fluid parameter, said second printer function control value being different than said first printer function control value.

17. The method of claim 10, wherein said inkjet printhead includes a printhead memory element having printhead memory element parameters, said inkjet printer combining at least one parameter from said printhead memory element and at least one parameter from said second memory to derive a third printer function control value.

* * * * *

UNITED STATES PATENT AND TRADEMARK OFFICE

CERTIFICATE OF CORRECTION

PATENT NO. : 6,375,301 B1
DATED : April 23, 2002
INVENTOR(S) : Childers et al.

It is certified that error appears in the above-identified patent and that said Letters Patent is hereby corrected as shown below:

Column 6,
Line 52, delete "an outlet end" and insert therefor -- an outlet end, the outlet end --.

Signed and Sealed this

Sixteenth Day of December, 2003

JAMES E. ROGAN
*Director of the United States Patent and Trademark Office*